US009694407B2

(12) United States Patent
Herrmann et al.

(10) Patent No.: US 9,694,407 B2
(45) Date of Patent: Jul. 4, 2017

(54) MACHINE AND METHOD FOR TREATING CAST COMPONENTS

(71) Applicant: MAGNA BDW TECHNOLOGIES GMBH, Markt Schwaben (DE)

(72) Inventors: Christian Herrmann, Munich (DE); Martin Kern, Gars (DE); Jürgen Lange, Erding (DE); Thomas Lanzl, Haag (DE); Helmut Meindl, Buch am Buchrain (DE)

(73) Assignee: MAGNA BDW TECHNOLOGIES GMBH, Markt Schwaben (DE)

( * ) Notice: Subject to any disclaimer, the term of this patent is extended or adjusted under 35 U.S.C. 154(b) by 68 days.

(21) Appl. No.: 14/463,739

(22) Filed: Aug. 20, 2014

(65) Prior Publication Data

US 2015/0052964 A1 Feb. 26, 2015

(30) Foreign Application Priority Data

Aug. 20, 2013 (DE) ..... 10 2013 216 435

(51) Int. Cl.

| | |
|---|---|
| ***B21D 7/16*** | (2006.01) |
| ***B22D 30/00*** | (2006.01) |
| ***C21D 1/673*** | (2006.01) |
| ***B21D 3/10*** | (2006.01) |
| ***B22D 29/04*** | (2006.01) |
| ***B22D 31/00*** | (2006.01) |

(52) U.S. Cl.

CPC ..... *B21D 7/165* (2013.01); *B21D 3/10* (2013.01); *B22D 29/04* (2013.01); *B22D 30/00* (2013.01); *B22D 31/002* (2013.01); *C21D 1/673* (2013.01)

(58) Field of Classification Search

CPC ... B21D 3/10; B21D 7/06; B21D 7/16; B21D 7/165; B22D 27/09; B22D 27/11; B22D 29/04; B22D 30/00; B22D 31/002; B22D 22/022; B21J 1/006; B21J 1/02; B21J 1/04; B21J 1/06; B21J 5/002; C21D 1/62–1/673

USPC .. 72/31.02, 31.03, 342.1, 342.2, 342.5, 364, 72/453.01, 703, 702

See application file for complete search history.

(56) References Cited

U.S. PATENT DOCUMENTS

| | | | | |
|---|---|---|---|---|
| 4,144,730 A * | 3/1979 | Judge, Jr. | ..... | B21D 3/16 72/18.1 |
| 2002/0170635 A1* | 11/2002 | DiSerio | ..... | B21J 5/00 148/552 |
| 2011/0221151 A1* | 9/2011 | Sakamoto | ..... | B21J 1/06 280/124.1 |

FOREIGN PATENT DOCUMENTS

| | | |
|---|---|---|
| DE | 1527253 A | 7/1969 |
| DE | 10329525 A1 | 2/2005 |

(Continued)

OTHER PUBLICATIONS

Machine Translation of Description of JPS611422 provided by JPO website.*

(Continued)

*Primary Examiner* — Peter DungBa Vo
*Assistant Examiner* — Joshua D Anderson
(74) *Attorney, Agent, or Firm* — Jordan IP Law, LLC; Todd A. Vaughn

(57) ABSTRACT

A machine for cooling and truing cast components made from cast material, and includes a construction for holding cast components and a holder to supply cooling liquids. A method to treat a cast component after removal of the cast component from the casting mold, the cast component being loaded immediately with a cooling liquid in a water spray.

6 Claims, 3 Drawing Sheets

(56) References Cited

FOREIGN PATENT DOCUMENTS

| | | | |
|---|---|---|---|
| DE | 10329525 | B4 | 2/2005 |
| DE | 102004043401 | A1 | 3/2006 |
| JP | S611422 | A | 1/1986 |
| WO | 2008031745 | A1 | 3/2008 |

OTHER PUBLICATIONS

Human Translation of JP61-001422 provided by USPTO Nov. 2016.*

Huang Zhiyuan et al., "Development and Application of Hot Rectification Technology in Al Alloy Die Castings", Aug. 31, 2011, pp. 731-733, Guangdong Hongtu Technology Co., Ltd. (English Abstract included).

* cited by examiner

MACHINE AND METHOD FOR TREATING CAST COMPONENTS

CROSS-REFERENCE TO RELATED APPLICATIONS

The present application claims priority 35 U.S.C. §119 to German Patent Publication No. DE 10 2013 216435.1 (filed on Aug. 20, 2013) which is hereby incorporated by reference in its entirety.

TECHNICAL FIELD

Embodiments relate a machine for cooling and truing cast components made from cast material, and includes a construction for holding cast components and a holder to supply cooling liquids.

Embodiments relate to a method to treat a cast component after removal of the cast component from the casting mould, the cast component being loaded immediately with a cooling liquid in a water spray.

BACKGROUND

Aluminium die cast components are used increasingly in automotive engineering. Here, there are requirements for die cast components which are produced more and more precisely and are also large in size. The cast components which are produced using die casting are subjected to different treatment processes in the prior art, one method step being truing the cast components to the specified dimensions. Here, the cast components are trued in stamping dies which exist in single-piece or segmented form.

German Patent Publication DE 102004043401A1 discloses a truing method which operates using segmented stamping dies. A multiplicity of components are still trued by hand.

Truing of the cast components is a complex work step which there is a desire to avoid as far as possible in industrial manufacturing. The aim is to obtain highly precise cast components from a die casting process, which cast components correspond to the specifications without further outlay with or without a further thermal treatment step.

A conventional method is illustrated in FIG. 1*a*. In the first step (casting 1), the casting component is produced using die casting or else in another casting process. In die casting, the rams of the moulds are first of all positioned by way of hydraulic cylinders and the die casting mould is closed by the casting machine. The filling chamber of the die casting system is loaded by means of compressed air with the required metal quantity for each casting by way of pressure loading of the liquid metal surface of the dosing furnace. The liquid metal is then pressed in during the "casting." Here, the piston rod of the casting cylinder of the casting machine exerts pressure on what is known as the casting tablet. The filling chamber for the liquid metal is connected via the casting channels to the mould cavities and is thus kept under pressure by way of the liquid alloy. The liquid metal thus passes under defined pressure and temperature conditions into the mould cavity which is formed by way of slides and cores. Here, the slug for the actual die casting article is produced during cooling. The casting subsequently cools while the mould is closed. The mould is opened and a robot removes the respective casting.

In step 2 (cooling of the cast component in the water spray), the cast component 10 is subjected to cooling. Here, the cast component 10 is sprayed with water or another liquid with a high thermal capacity in a defined time period. As an alternative to this, the cast component can also be dipped. As a result, the cast component is cooled rapidly from the removal temperature from the casting mould to a temperature at which the cast component can be fed to further method steps. To this end, a robot removes the cast component from the casting mould, by said robot gripping the casting tablet of the cast component and removing the cast component together with the casting tablet and moulded casting flow runners from the mould. The casting tablet with all the components moulded thereon, including the cast component itself, is introduced into a station for a water spray. The cast component is locked in the station via the casting tablet and is sprayed with water there.

After the cooling time, the robot removes the casting tablet and cast component from the station again and deposits them in the station 3 for stamping the cast component. The casting tablet and casting flow runners are cut off there in a cutting tool. As an alternative, the methods of sawing, laser and plasma cutting can also be used.

In step 4, the thermal treatment of the cast component takes place. Here, the thermal treatment is not a step which definitely has to take place, but is rather present optionally. The thermal treatment can be thermal treatment of T5, that is to say artificial ageing, or solution annealing. In solution annealing, a customary thermal treatment process for aluminium die cast parts, a temperature is set between 460° C. and 500° C.

Overall, the cast component experiences a distortion after its production in the die casting mould and a possible thermal treatment, with the result that the cast component no longer corresponds to the specifications. The truing of the cast component to the desired final dimensions therefore takes place in step 5, the cast component being cooled completely in said method step.

The machining 6 of the cast component would be realized in a last step.

SUMMARY

In accordance with embodiments, a machine and a method to treat a cast component after removal from a casting mould, the casting component being loaded immediately with a cooling liquid in a water spray.

In accordance with embodiments, provided is a machine for cooling and truing cast components made from cast material, and which includes a device for holding cast components and a holder for supplying cooling liquids. The machine further includes a device for holding the cast component and truing pressure cylinders with truing rams being installed which press the cast component against pads. The advantage of a machine of this type lies in the fact that two operations, such as cooling and truing of cast components, may be carried out in a single process step and one system. Furthermore, it is advantageous that the truing takes place in the hot state of the cast component.

The machine also advantageously comprises a removable pad holder, with the result that simple measuring of the pads and re-adjusting of the pads is possible by way of removal of the pad holder.

The machine is advantageously constructed in such a way that all the pads are attached on one side of the cast component and all the fastening and truing rams are attached on the other side. As a result, all the pressure cylinders are likewise attached on one side and the entire construction of the machine is simpler.

It can also be advantageous, however, to construct the machine in such the way that both pads and fastening and truing rams are attached in each case on both sides of the cast component. In this way, even more improved deformation of the cast component can take place.

In accordance with embodiments, the method for treating a cast component after removal from the casting mould advantageously has the process step that, before the cooling liquid is applied to the cast component, the cast component is subjected to a truing operation in the still hot state. Here, the cast component is advantageously trued to the final dimensions.

It can also be advantageous, however, that the cast component is bent beyond its final dimensions, since there is further distortion as a result of further thermal treatment steps and the truing process already provides overbending of the cast component here as a precaution.

In accordance with embodiments, at least one truing tip is advantageously used to carry out the method. Such at least one truing tip advantageously bends the cast component against at least one truing pad, it being possible for the truing pad to be adjustable.

The cast component is advantageously held by way of ram and pad until it is cooled by way of the application of the cooling liquid.

DRAWINGS

Embodiments will be illustrated by way of example in the drawings and explained in the description below.

FIG. 1*a* illustrates a diagram of a conventional process.

FIG. 1*b* illustrates a diagram of a method in accordance with embodiments.

DESCRIPTION

Figure 1A:
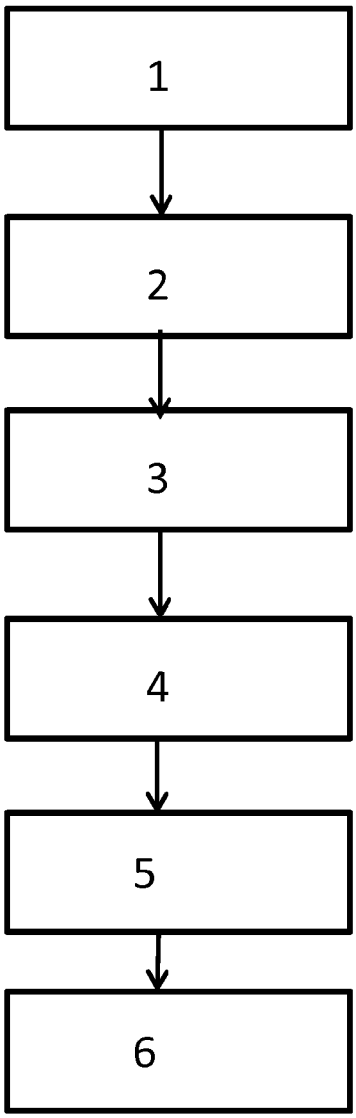
Figure 1B:
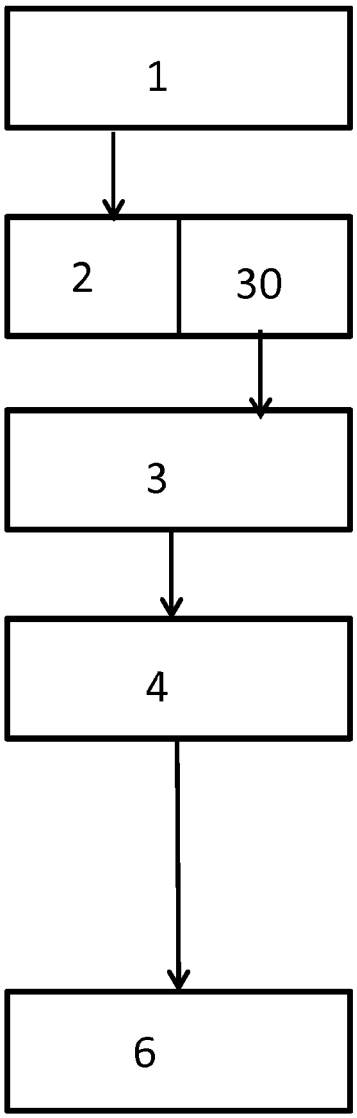

As illustrated in FIG. 1*b*, the method in accordance with embodiments includes casting whereby the casting component is produced using die casting or else in another casting process.

A subsequent step 2 includes cooling of the cast component 10 using a liquid having a high thermal capacity for a defined time period. Alternatively or additionaly, the cast component 10 may also be dipped. As a result, the cast component is cooled rapidly from the removal temperature from the casting mould to a temperature at which the cast component can be fed to subsequent steps.

In order to optimize the cast components, the method in accordance with embodiments uses a combined step which takes place in the cooling phase 2 of the water spray and includes truing in the warm state 30. To this end, the cast component is removed from the casting mould by way of a robot and, held on the casting tablet, is introduced into the water spray station.

In the water spray, the cast component is pressed against a pad and is held by way of fastening rams from the side which faces away from the pad. The fastening rams are extended pneumatically or hydraulically with the aid of fastening ram pressure cylinders. In order to mount the cast component appropriately, at least two fastening rams are used. The fastening rams are seated flush on the cast component from both sides. Subsequently, truing rams are extended via truing cylinders. They come into contact with the cast component which is not seated flush on a truing pad at this point. Via the pressure of the truing ram, the cast component is deformed until it bears on the truing pad.

The cast component is trued with regard to its dimensions by way of said process step. Here, the truing process either takes place until the target dimensions are reached, or the cast component is pre-deformed beyond the target dimensions, since the following thermal treatment reverses the deformation partially and the cast component therefore finally reaches the correct dimensions.

A subsequent step 3 involves, after the cooling time, stamping the cast component 10. The casting tablet and casting flow runners are cut off using a cutting tool. Alternatively, sawing, laser and plasma cutting may also be used.

In subsequent step 4, a thermal treatment of the cast component 10 may occur. takes place. The thermal treatment, however, may occur optionally. The thermal treatment can be thermal treatment in accordance with T5, i.e., artificial ageing, or solution annealing. In solution annealing, a customary thermal treatment process for aluminium die cast parts, a temperature is set between 460° C. and 500° C.

In subsequent step 6, machining 6 of the cast component 10 is conducted.

Accordingly, in contrast to the conventional method illustrated in FIG. 1*a*, in accordance with embodiments, the method in accordance with embodiments differs essentially in that the step 5 (truing in the cold state) may be dispensed with or can be reduced to a minimum in the case of complex components.

Figure 2:
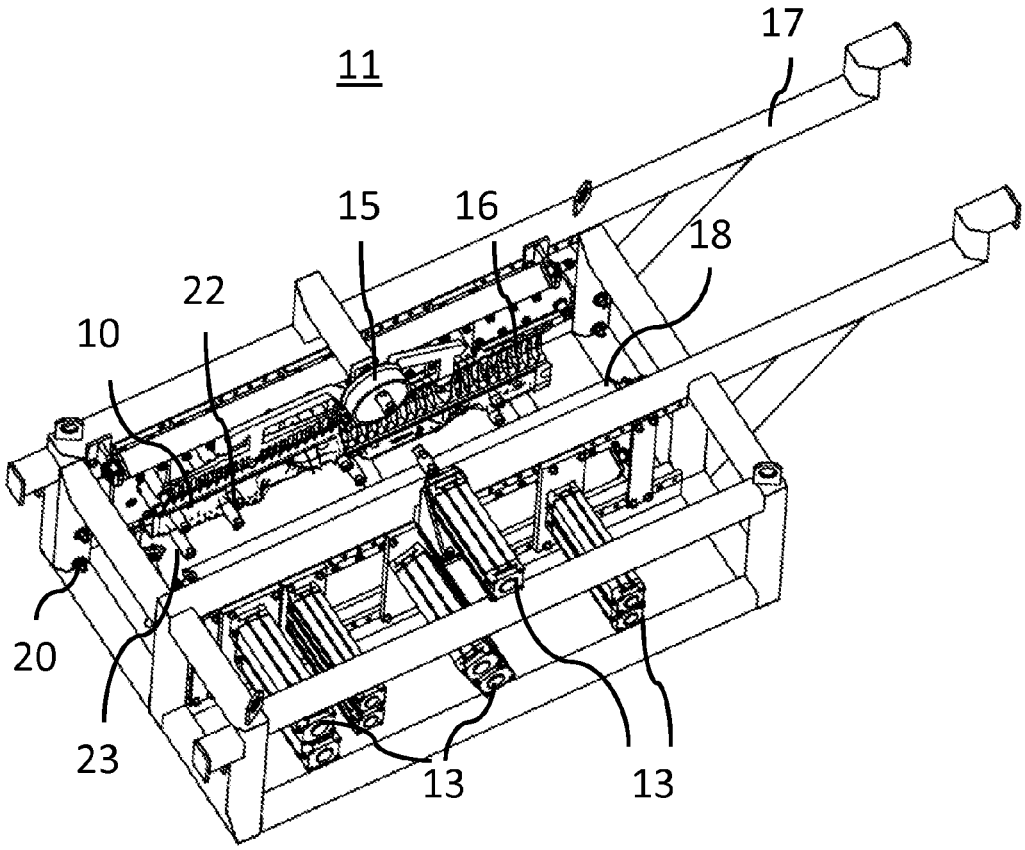
FIG. 2 illustrates a machine for a water spray and for truing.
Figure 3:
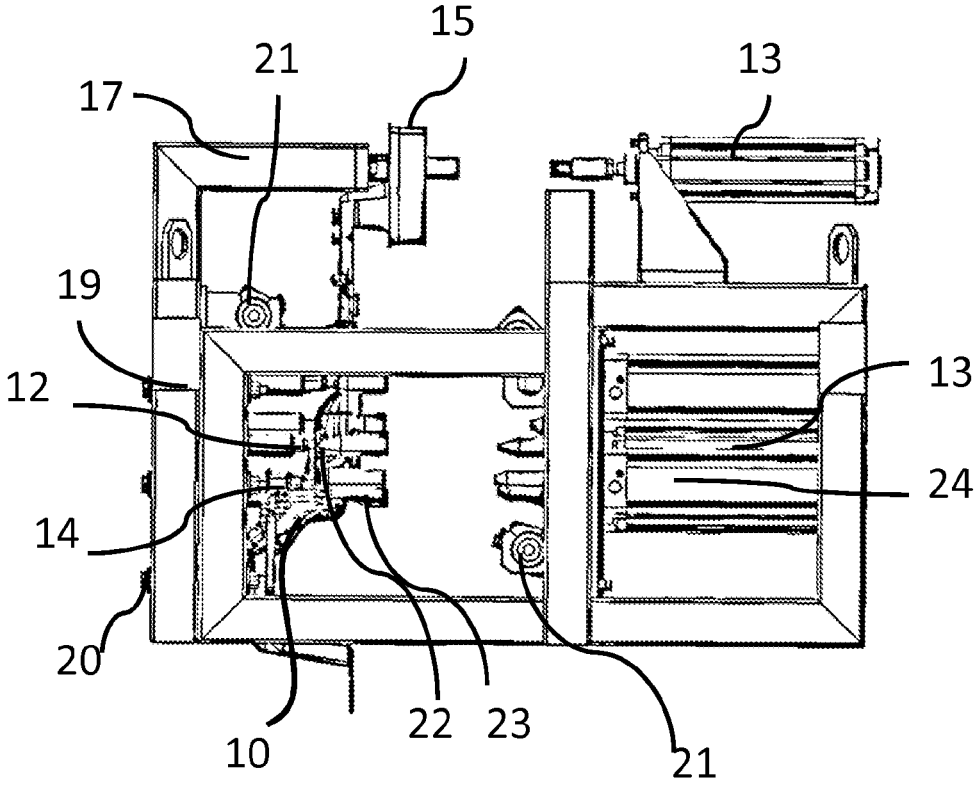
FIG. 3 illustrates a section through the machine.

FIGS. 2 and 3 illustrate the water spray/part-truing station as a machine tool. The entire water spray 11 is constructed and welded from grid rails 17. The casting tablet 15 and the casting flow runners 16 can be seen in the upper part of the water spray station in FIG. 2. The reference numeral 10 marks the cast component. In the lower half, pressure cylinders 13, 14 are mounted on a cylinder plate 18, the pressure cylinders serving firstly for fastening and secondly for truing. In a conventional water spray, the cast component 10 would be held fixedly on the casting tablet only via the uppermost pressure cylinder 13. Cooling with water or another liquid subsequently takes place.

In accordance with embodiments, for the water spray, the cast component is held by a plurality of pressure cylinders 13. There are fastening pads 12 opposite the pressure cylinders and behind the cast component 10, which fastening pads 12 bear flush against the cast component at the fastening points. The fastening rams which are extended by the pressure cylinders 13 fix and clamp the cast component between themselves and the fastening pads 12.

Truing rams 23 which bend the cast component are extended via truing cylinders 24. Here, bending deflections of several millimeters are possible, until the cast component reaches the truing pads 14. Here, the illustration in FIG. 2 illustrates fastening rams 22 and truing rams 23, the connection to the individual pressure cylinders not being illustrated.

The entire situation can be seen once again in FIG. 3. The fastening rams 22 and the truing rams 23 are seated on the cast component 10. Here, the fastening pad 12 is already connected to the rear side of the cast component during the introduction of the cast component into the water spray. In contrast, the truing pad 14 is provided at a spacing from the cast component at the beginning The spacing from the truing pad 14 is reduced to zero only after the truing pressure cylinder 24 presses the truing tip 22 onto the cast component. The cast component is trued or overbent. After all the truing cylinders have reached their setpoint value, the water is released via the water supply 21 and the cast component is cooled to the end temperature within the water spray.

It can be seen on the left-hand side of the drawing that the grid rails 17 form a pad holder 19 in the region of the pad. The pad holder 19 is connected to the rest of the construction via screws 20 and can be detached from it. The pad holder can therefore be removed from the machine with all the fastening pads 12 and truing pads 14 and can be measured and adjusted on a measuring machine. Here, the pads are optimized by way of adapting shims.

The embodiment which is illustrated of the machine for cooling and truing cast components is advantageously configured in such a way that all the pressure cylinders are attached on one side of the processing station. As a result, the space requirement which is produced as a result of the overall size of the pressure cylinders can be optimized.

It is also possible, however, to use a machine of this type for more complicated and more complex truing tasks and therefore to deform the cast component 10 with truing rams from both sides. To this end, pressure cylinders have to be attached on the left-hand side of FIG. 3, and truing rams have to extend through the pad holder 19. The corresponding truing pads 14 would of course have to be attached on the right-hand side.

In terms of the time sequence, it is not absolutely necessary to delay cooling until the truing tools are extended and the bending of the component is concluded.

In order to optimize the process, the cooling process can be started in parallel with the truing process.

The term "coupled" or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments may be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

LIST OF REFERENCE NUMERALS

1 Casting
2 Cooling of the cast component in the water spray
3 Stamping
4 Thermal treatment
5 Truing
6 Machining
10 Cast component
11 Water spray
12 Fastening pads
13 Pressure cylinder
14 Truing pad
15 Casting tablet
16 Casting flow runners
17 Grid rails
18 Cylinder plate
19 Pad holder
20 Screws
21 Water supply
22 Fastening ram
23 Truing ram
24 Setting pressure cylinder
30 Hot truing

What is claimed is:

1. A method for treating a cast component after removal of the cast component from a casting mould, the method comprising:

after removal of the cast component from the casting mould, overbending the cast component while in a hot state by bending the cast component beyond target dimensions for the cast component, wherein a cooling liquid is applied to the cast component in parallel with the bending of the cast component; and after applying the cooling liquid to the cast component, subjecting the cast component to a thermal treatment that partially reverses the bending of the cast component to obtain the target dimensions for the cast component.

2. The method of claim 1, wherein the truing comprises bending the cast component via at least one truing tip.

3. The method of claim 1, wherein the truing comprises bending the cast component against at least one truing pad.

4. The method of claim 3, wherein the truing pad is adjustably moveable.

5. The method of claim 1, further comprising stamping the cast component, after applying the cooling liquid and before subjecting the cast component to a thermal treatment.

6. The method of claim 1, further comprising machining the cast component, after applying the cooling liquid.

* * * * *